US009932726B2

(12) United States Patent
Song et al.

(10) Patent No.: US 9,932,726 B2
(45) Date of Patent: Apr. 3, 2018

(54) FAST INSTALLATION STRUCTURE ON FAUCET TABLE

(71) Applicant: Xiamen Runner Industrial Corporation, Xiamen (CN)

(72) Inventors: Jian-Yi Song, Xiamen (CN); Jun-Sheng Wang, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 20 days.

(21) Appl. No.: 15/188,999

(22) Filed: Jun. 22, 2016

(65) Prior Publication Data

US 2017/0009433 A1 Jan. 12, 2017

(30) Foreign Application Priority Data

Jul. 7, 2015 (CN) ..... 2015 1 0392896

(51) Int. Cl.
*E03C 1/04* (2006.01)

(52) U.S. Cl.
CPC ..... *E03C 1/0401* (2013.01); *E03C 1/0402* (2013.01); *E03C 2001/0416* (2013.01)

(58) Field of Classification Search
CPC ..... E03C 1/0401
USPC ..... 4/675–678
See application file for complete search history.

(56) References Cited

U.S. PATENT DOCUMENTS 6,611,972 B2 * 9/2003 Underbrink ..... A47K 1/02 4/619
8,689,830 B2 * 4/2014 Chen ..... E03C 1/0404 137/625.31
9,657,466 B2 * 5/2017 Esche ..... E03C 1/0404
2007/0012727 A1 * 1/2007 Licari ..... A47K 5/12 222/167
2009/0230200 A1 * 9/2009 Kempf ..... E03B 7/045 236/12.11

* cited by examiner

*Primary Examiner* — Lori Baker
(74) *Attorney, Agent, or Firm* — Chun-Ming Shih

(57) ABSTRACT

A fast installation structure on a faucet table, comprising: a table plane and a bottom seat. The bottom seat is disposed on the table plane, and is used to install a faucet, including: a connection tube; a lock tight device, disposed and screwed around the connection tube; and at least two position holding block, disposed at a lower portion of the connection tube, and are repulsive to each other magnetically. The lock tight device is a lock tight ring or a lock tight screw. The outer threads are provided on the connection tube, while inner threads are provided on the lock tight ring, such that the lock tight ring and the connection tube are connected through threading. At least two installation slots are disposed symmetrically at a lower portion of the connection tube, for receiving the position holding blocks.

4 Claims, 7 Drawing Sheets

FAST INSTALLATION STRUCTURE ON FAUCET TABLE

BACKGROUND OF THE INVENTION

Field of the Invention

The present invention relates to an installation structure on a faucet table, and in particular to a fast installation structure on a faucet table, and a method of installing the same.

The Prior Arts

Presently, the structure for installing faucet on a basin table has the shortcomings that, it is complicated in structure, and requiring voluminous space, so that its installation is slow, and it occupies the space used for installing water pipes and the related accessories.

Therefore, presently, the design of installation structure on a faucet table is not quite satisfactory, and it leaves much room for improvement.

SUMMARY OF THE INVENTION

In view of the problems and drawbacks of the prior art, the present invention provides a fast installation structure on a faucet table, to overcome the shortcomings of the prior art.

The present invention provides a fast installation structure on a faucet table, comprising: a table plane and a bottom seat. The bottom seat is disposed on the table plane, and is used to install a faucet, including: a connection tube; a lock tight device, sleeved and screwed around the connection tube; and at least two position holding block, disposed at a lower portion of the connection tube, and are repulsive to each other magnetically.

In an aspect of the present invention, the lock tight device is a lock tight ring or a lock tight screw.

In another aspect of the present invention, outer threads are provided on the connection tube, while inner threads are provided in the lock tight ring, such that the lock tight ring and the connection tube are connected through threading.

In yet another aspect of the present invention, at least two installation slots are disposed symmetrically at a lower portion of the connection tube, for receiving the position holding blocks, while outer threads are provided above the installation slot, such that the position holding block moves radially in the installation slot relative to the connection tube.

In a further aspect of the present invention, the position holding block includes: an arc-shape portion, with its outer face being a position restriction block face; a protrusion, extending outward from a central portion of the position restriction block face, to act in cooperation with the installation slot.

In another aspect of the present invention, a magnet is provided at an inner side of the arc-shape portion; or the position holding block is formed into one piece of magnetic material.

In a further aspect of the present invention, a fixing slot is disposed in a central portion on an outer side of the lock tight ring, or an elastic block ring having a position restriction elastic arm is sleeved onto a connection tube between the lock tight ring and the position holding block.

The present invention also provides a fast installation structure on a faucet table installation method, comprising the following steps:

(1) assembling a bottom seat, to place two position holding blocks in an installation slot of a connection tube, then connect a lock tight ring with the connection tube through threading, to finish assembling the bottom seat;

(2) inserting the bottom seat into an installation hole of the table plane, the position holding block is first squeezed into the connection tube through an inner wall of the installation hole, at this time, when the installation slot at a lower portion of the connection tube penetrates through the installation hole, due to the magnetic repulsion force, the two position holding blocks are magnetically repulsive to each other, to move toward outside the connection tube to hold positions;

(3) screwing downward the lock tight ring tightly, to fix the bottom seat securely; and (4) sleeving the faucet around the bottom seat, to fix the faucet securely through fixing it onto the fixing slot of the lock tight ring by using a fixing bolt, or to fix the faucet securely through using a position restriction elastic arm over the table plane.

Compared with the Prior Art, the present invention has the following advantages: it is simple in construction, easy and facile to install; and it adopts at least two magnetically repulsive position holding blocks to perform position holding, while leaving enough space for installing water pipes and related accessories. In addition, it provides good hand-feel, and it is convenient to operate.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

Figure 1:
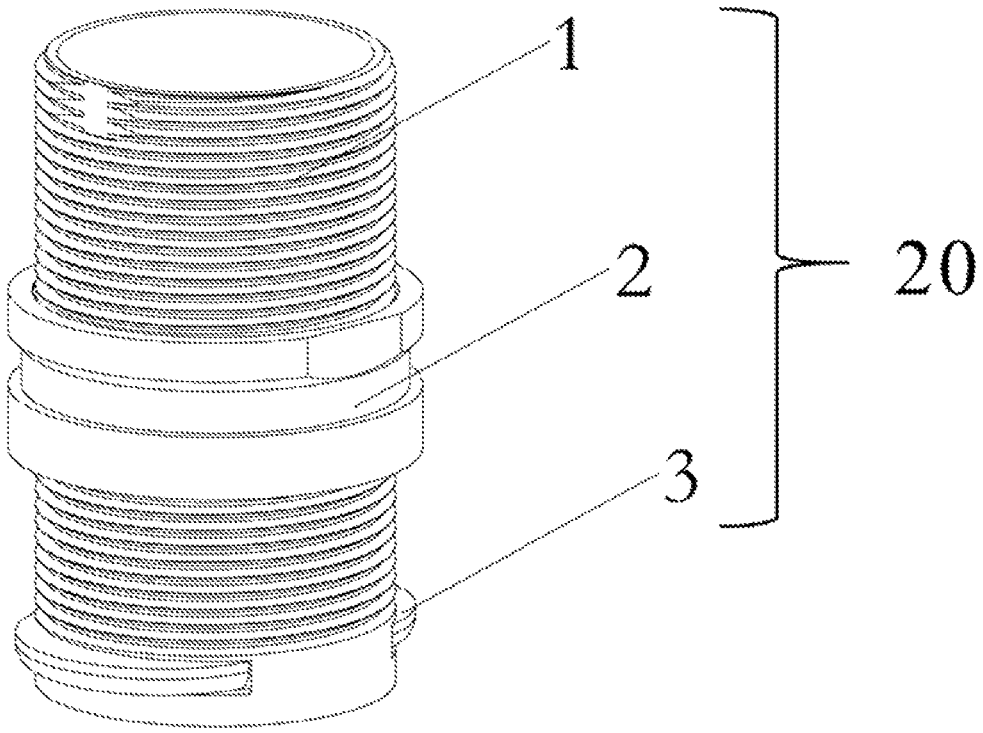
FIG. 1 is a schematic diagram of a fast installation structure on a faucet table according to an embodiment of the present invention.
Figure 2:
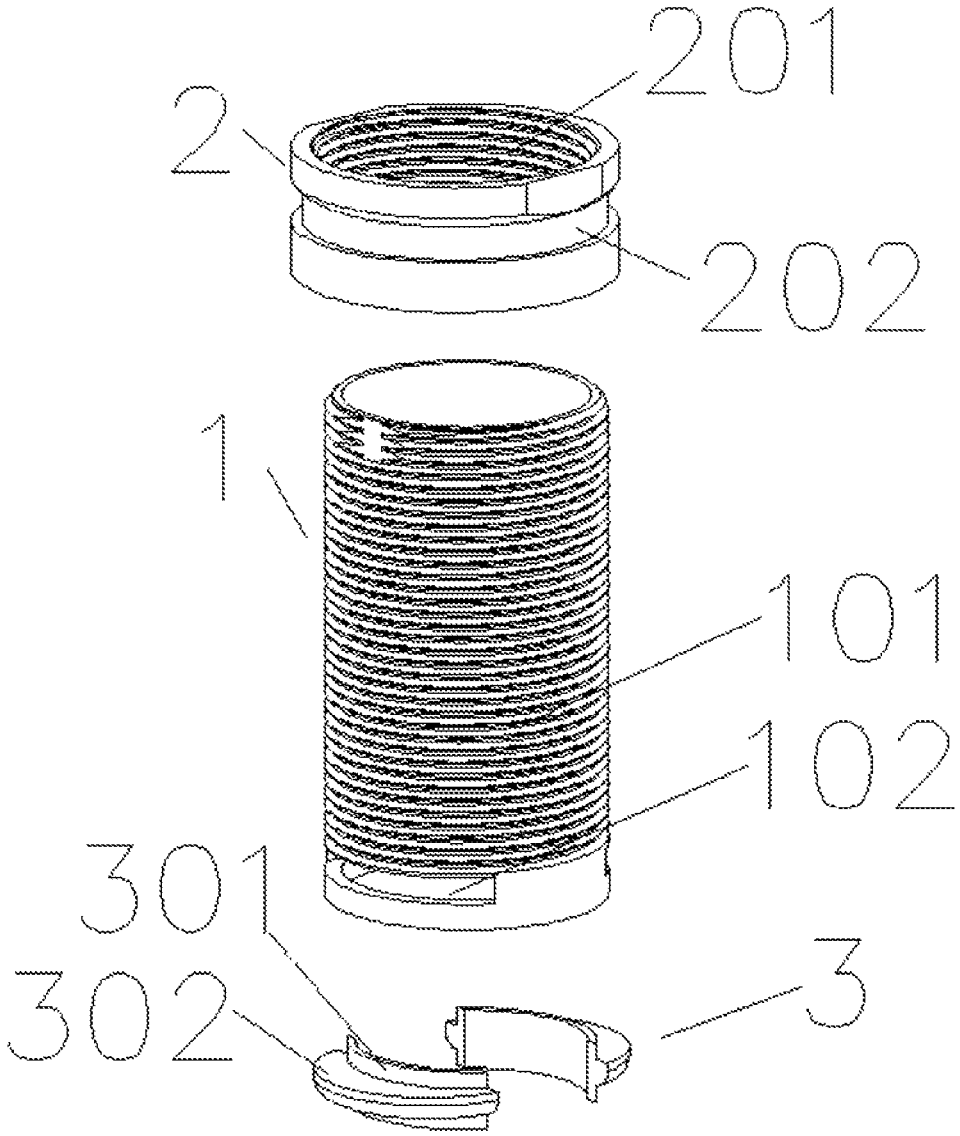
FIG. 2 is an exploded view of a fast installation structure on a faucet table according to an embodiment of the present invention.
Figure 3A:
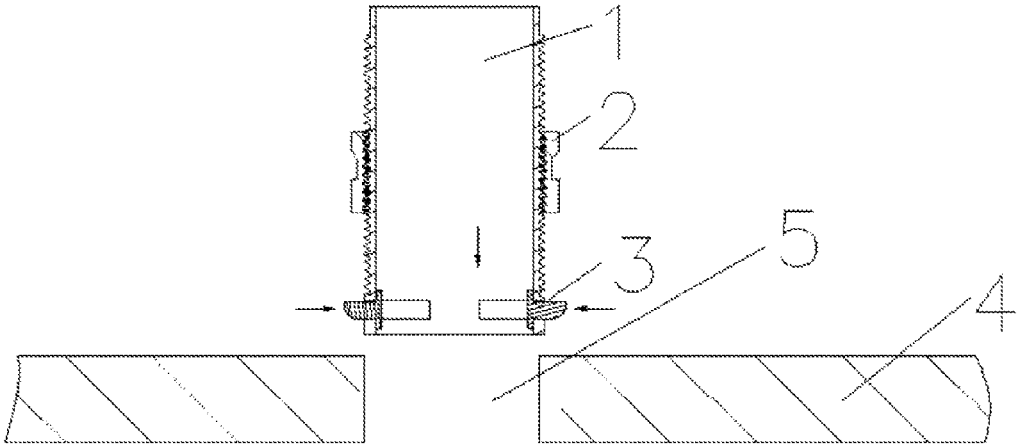
FIGS. 3A to 3D are the schematic diagrams of various parts of a fast installation structure on a faucet table during various steps of installation according to an embodiment of the present invention.
Figure 3B:
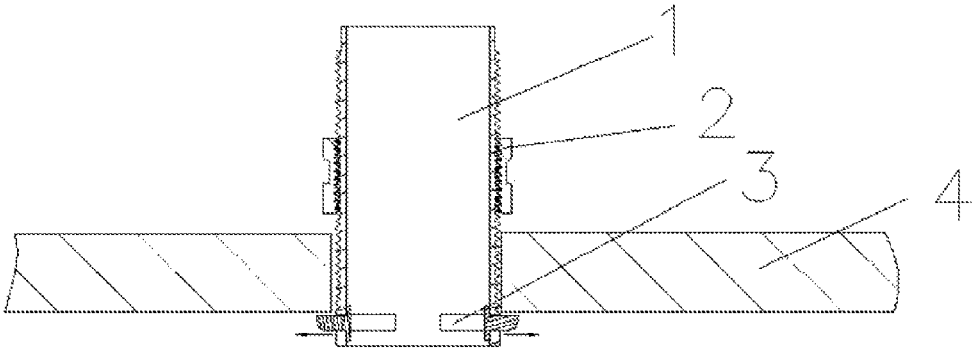
Figure 3C:
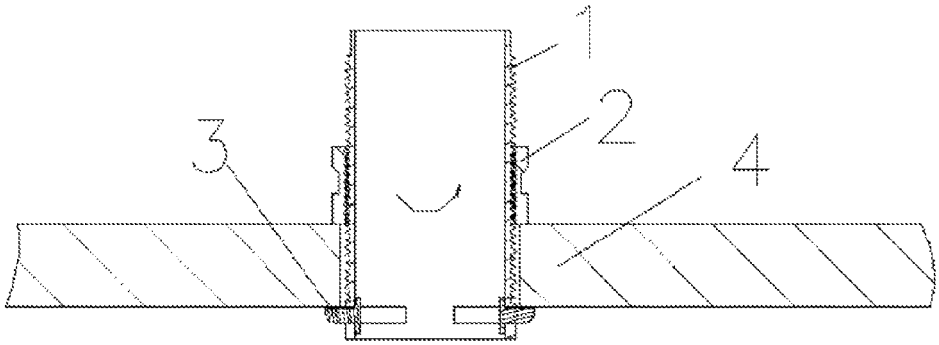
Figure 3D:
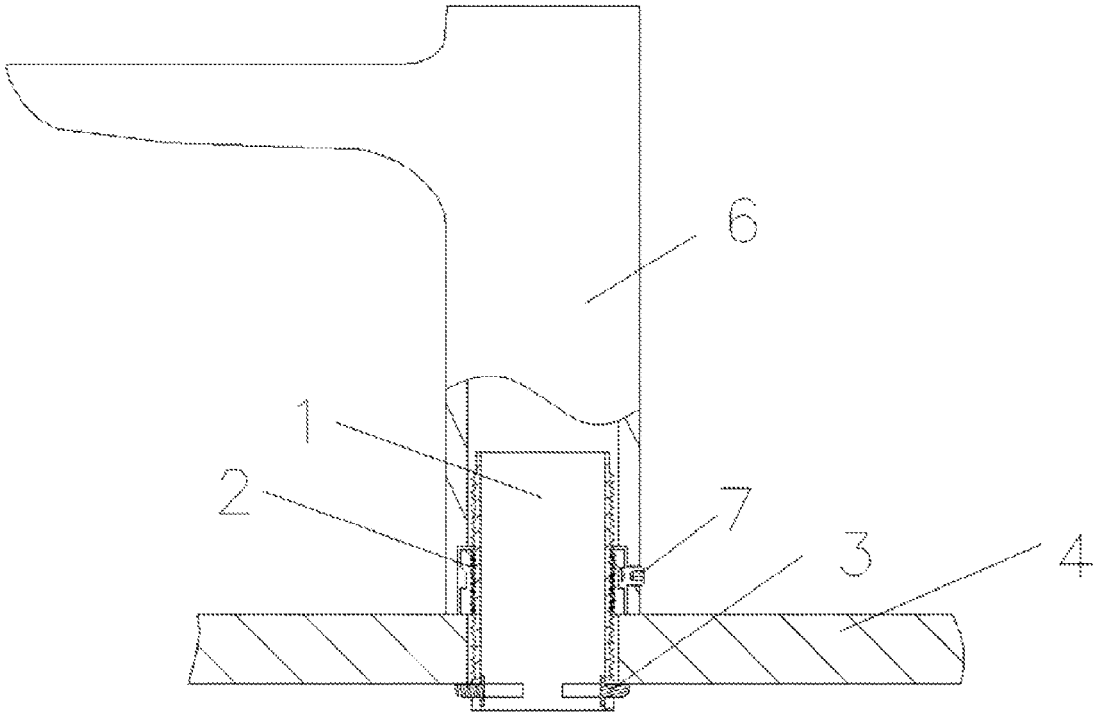
Figure 4:
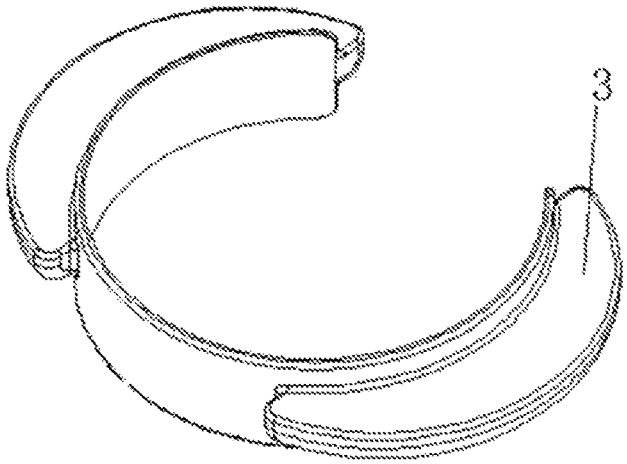
FIG. 4 is a schematic diagram of a position holding block according to an embodiment of the present invention.

The purpose, construction, features, functions and advantages of the present invention can be appreciated and understood more thoroughly through the following detailed description with reference to the attached drawings.

Refer to FIGS. 1 to 7 respectively for a schematic diagram of a fast installation structure on a faucet table according to an embodiment of the present invention; a exploded view of a fast installation structure on a faucet table according to an embodiment of the present invention; the schematic diagrams of various parts of a fast installation structure on a faucet table during various steps of installation according to an embodiment of the present invention; a schematic diagram of a position holding block according to an embodiment of the present invention; a schematic diagram of a lock tight device according to an embodiment of the present invention; a schematic diagram showing a position restriction elastic arm according to an embodiment of the present invention; and a schematic diagram showing a bottom seat and a position restriction elastic arm disposed in cooperation according to an embodiment of the present invention.

As shown in FIGS. 1 to 7, the present invention provides a fast installation structure on a faucet table, comprising: a table plane 4 and a bottom seat 20. The bottom seat is disposed on the table plane 4, and is used to install a faucet 6, including: a connection tube 1; a lock tight device 2, sleeved and screwed around the connection tube 1; and at least two position holding blocks 3, disposed at a lower portion of the connection tube 1, and are repulsive to each other magnetically.

Figure 5:
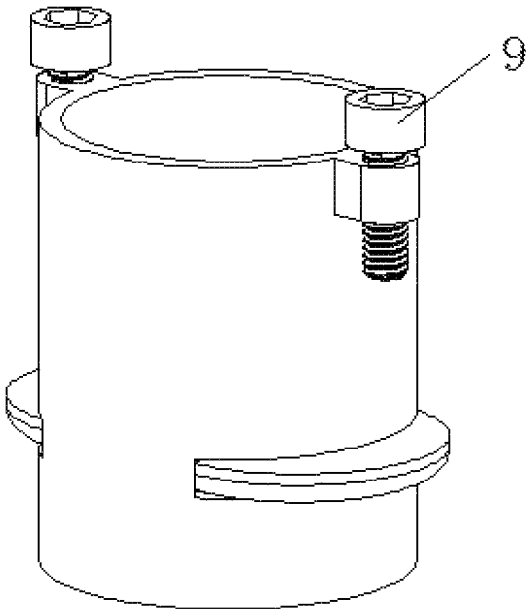
FIG. 5 is a schematic diagram of a lock tight device according to an embodiment of the present invention.
Figure 6:
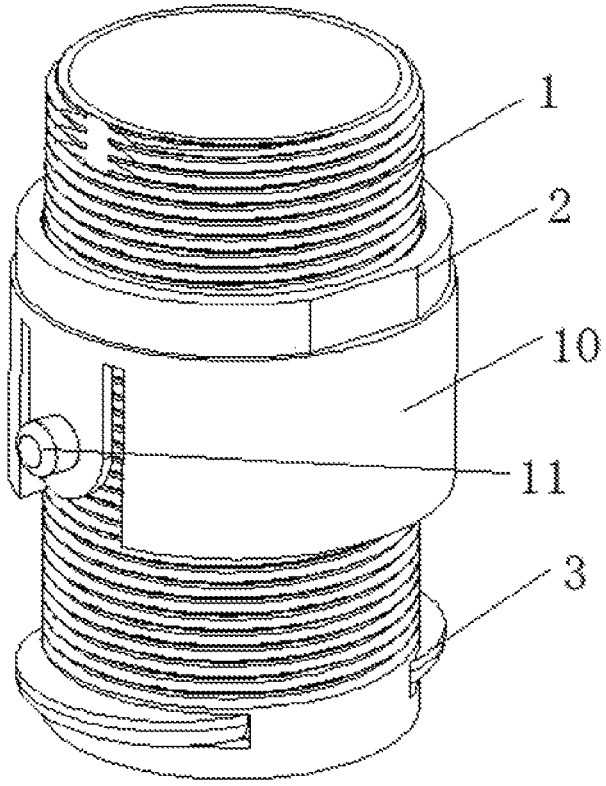
FIG. 6 is a schematic diagram showing a position restriction elastic arm according to an embodiment of the present invention.
Figure 7:
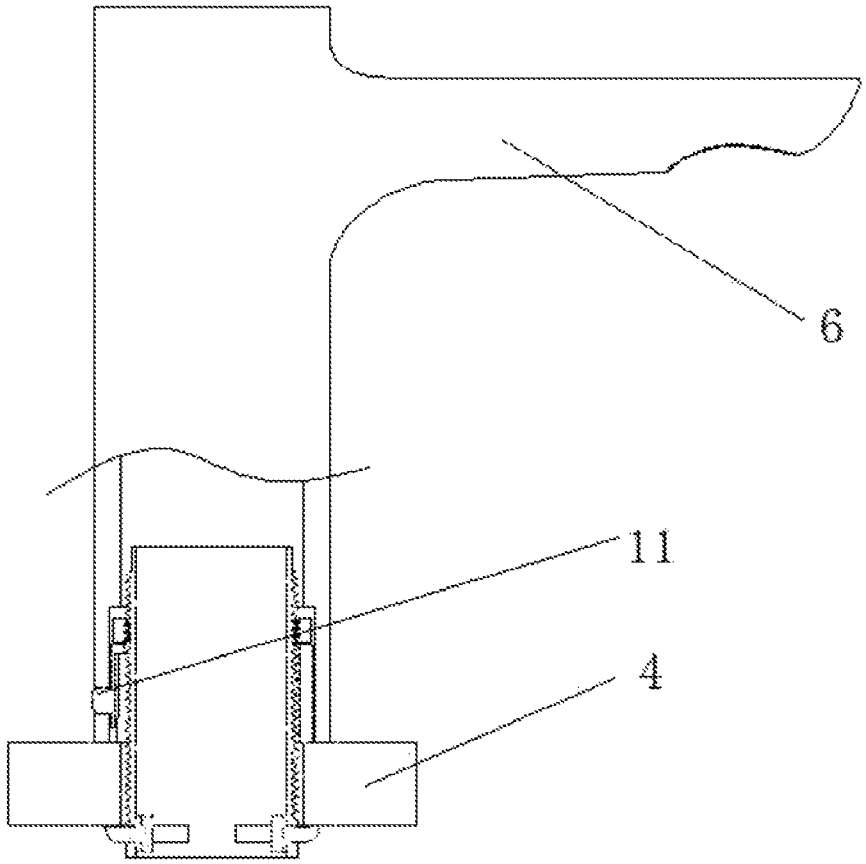
FIG. 7 is a schematic diagram showing a bottom seat and a position restriction elastic arm disposed in cooperation according to an embodiment of the present invention.

In an embodiment of the present invention, the lock tight device 2 is a lock tight ring or a lock tight screw 9 (as shown in FIG. 5).

In an embodiment of the present invention, outer threads 101 are provided on the connection tube 1, while inner threads 201 are provided in the lock tight ring 2, such that the lock tight ring 2 and the connection tube 1 are connected through threading.

In an embodiment of the present invention, at least two installation slots 102 are disposed symmetrically at a lower portion of the connection tube 1, for receiving the position holding blocks 3, while outer threads 101 are provided above the installation slot 102, such that the position holding block 3 moves radially in the installation slot 102 relative to the connection tube 1.

In an embodiment of the present invention, the position holding block 3 includes: an arc-shape portion, with its outer face being a position restriction block face 301; and a protrusion 302, extending outward from a central portion of the position restriction block face 301, to act in cooperation with the installation slot 102.

In an embodiment of the present invention, a magnet is provided on an inner side of the arc-shape portion; or the position holding block 3 is formed into one piece of magnetic material.

In an embodiment of the present invention, a fixing slot 202 is disposed in a central portion on an outer side of the lock tight ring 2, or an elastic block ring 10 having a position restriction elastic arm 11 is sleeved onto a connection tube 1 between the lock tight ring 2 and the position holding block 3.

The present invention also provides a fast installation structure on a faucet table installation method, comprising the following steps:

(1) assembling a bottom seat, to place two position holding blocks 3 in an installation slot 102 of a connection tube 1, then connect a lock tight ring 2 with the connection tube 1 through threading, to finish assembling the bottom seat;

(2) inserting the bottom seat into an installation hole 5 of the table plane 4, the position holding block 3 is first squeezed into the connection tube 1 through an inner wall of the installation hole 5, at this time, when the installation slot 102 at a lower portion of the connection tube 1 penetrates through the installation hole 5, due to the magnetic repulsion force, the two position holding block 3 are magnetically repulsive to each other, and move toward outside the connection tube 1 to hold positions;

(3) screwing downward the lock tight ring 2 tightly, to fix the bottom seat securely; and (4) sleeving the faucet 6 around the bottom seat, to fix the faucet 6 securely through fixing it onto the fixing slot 202 of the lock tight ring 2 by using a fixing bolt 7, or to fix the faucet 6 securely through using a position restriction elastic arm 11 over the table plane 4.

Compared with the Prior Art, the present invention has the following advantages: it is simple in construction, easy and facile to install; and it adopts at least two magnetically repulsive position holding blocks to hold positions, while leaving enough space for installing water pipes and related accessories. In addition, it provides good hand-feel, and it is convenient to operate.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A fast installation structure for installing a faucet on a faucet table, comprising:

a table plane; and a bottom seat, disposed on the table plane, including:

a connection tube;

a lock tight ring, sleeved and screwed around the connection tube; and at least two magnetic position holding blocks, disposed at a lower portion of the connection tube, and being repulsive to each other magnetically, wherein outer threads are formed on the connection tube, while inner threads are formed in the lock tight ring, such that the lock tight ring and the connection tube are connected through threading;

wherein at least two installation slots are disposed symmetrically at a lower portion of the connection tube, for receiving the two magnetic position holding blocks, respectively, while the outer threads are formed above the installation slot, such that the magnetic position holding block moves radially in the installation slot relative to the connection tube.

2. The fast installation structure on a faucet table as claimed in claim 1, wherein the magnetic position holding block includes:

an arc-shape portion, located inside the connection tube, with its outer face being a position restriction block face; and a protrusion, extending outward from a central portion of the position restriction block face, to act in cooperation with and protrude out of the installation slot.

3. The fast installation structure on a faucet table as claimed in claim 2, wherein a magnet is disposed on an inner side of the arc-shape portion.

4. The fast installation structure on a faucet table as claimed in claim 1, wherein a fixing slot is disposed in a central portion on an outer side of the lock tight ring, or an elastic block ring having a position restriction elastic arm is sleeved onto the connection tube between the lock tight ring and the position holding block.

* * * * *